US005979294A

United States Patent [19]

Hugelman

[11] Patent Number: 5,979,294

[45] Date of Patent: Nov. 9, 1999

[54] METHOD AND APPARATUS FOR CONTROLLING AXIAL PUMP

[75] Inventor: Rodney D. Hugelman, Champaign, Ill.

[73] Assignee: WhiteMoss, Inc., West Lafayette, Ind.

[21] Appl. No.: 08/977,961

[22] Filed: Nov. 25, 1997

Related U.S. Application Data

[63] Continuation-in-part of application No. PCT/US97/02337, Feb. 3, 1997, which is a continuation-in-part of application No. 08/598,725, Feb. 8, 1996, Pat. No. 5,724,879.

[51] Int. Cl.[6] ..... F01B 3/00; F01B 13/04

[52] U.S. Cl. ..... 92/12.2; 91/505; 91/506

[58] Field of Search ..... 92/12.2, 57, 70, 92/71; 91/499, 504, 505, 506

[56] References Cited

U.S. PATENT DOCUMENTS

| | | | |
|---|---|---|---|
| 3,010,339 | 11/1961 | Brock | 92/12.2 X |
| 3,139,037 | 6/1964 | Budzich | 91/505 X |
| 3,208,395 | 9/1965 | Budzich | 92/57 X |
| 3,223,042 | 12/1965 | Thresher | 92/12.2 X |
| 3,233,550 | 2/1966 | Smith | 92/12.2 X |
| 3,304,886 | 2/1967 | Roberts | 92/12.2 X |
| 3,486,454 | 12/1969 | Tuzson | 417/271 |
| 4,771,676 | 9/1988 | Matsumoto et al. | 92/57 |
| 4,771,677 | 9/1988 | Rohde et al. | 92/57 |
| 5,230,610 | 7/1993 | Reichenmiller | 91/499 X |
| 5,253,576 | 10/1993 | Bethke | 91/505 X |

FOREIGN PATENT DOCUMENTS 96 19666 6/1996 WIPO .

*Primary Examiner*—John E. Ryznic
*Attorney, Agent, or Firm*—Knechtel, Demeur & Samlan

[57] ABSTRACT

A control system, method and apparatus are provided in which a rotatable wedge portion which is solidly mounted on a rotatable base engages piston and cylinder assemblies as the base rotates. In another embodiment the rotatable base is not affixed to the shaft, but instead is allowed to rotate with respect to the shaft, while the shaft is affixed to the cylinder and piston, which rotate with the shaft. The wedge is rotatable through various positions relative to the base, thus providing an adjustable tilt angle and different strokes for the pistons. In another embodiment, the single wedge is replaced by a double wedge assembly.

9 Claims, 11 Drawing Sheets

METHOD AND APPARATUS FOR CONTROLLING AXIAL PUMP

This is a Continuation-In-Part of U.S. PCT Ser. No. US/97/02337 filed Feb. 3, 1997 which is a Continuation-In-Part of U.S. Ser. No. 08/598725 filed on Feb. 8, 1996, now U.S. Pat. No. 5,724,879.

BACKGROUND OF THE INVENTION

Fluid pumps, whether for liquids or gases, may be of the axial type, wherein a plurality of cylinders and pistons are aligned parallel to and disposed around a central axis. The pistons are actuated successively and with their strokes overlapping in time to provide continuous pumping of the working fluid.

One method and means of controlling piston actuation is to provide a wobble plate or swash plate which is tilted relative to the pump axis and rotates relative to the pistons. The plate engages the piston and cylinder assemblies so as to actuate each one successively as rotation takes place.

Typical adjustable wobble plate designs for axial pumps generally make use of a tilt platform with a pin-ended bearing support along the tilt axis. An external mechanism is then used to rotate the pin-ended platform. This configuration requires the tilt platform and pin-ended bearing structures to support the full pump thrust loads. Structural rigidity and dynamic performance are compromised with an accompanying increase in pump vibration, noise, and small stroke dynamic stability. An unnecessarily large pump envelope is required to accommodate this approach adding to pump cost and size while further exacerbating rigidity and noise problems.

SUMMARY OF THE INVENTION

A new adjustable stroke control method and apparatus for axial pumps is presented which corrects typical shortcomings while offering new possibilities to axial pump performance. The new control module is small, self-contained, and without the need for external tilt control mechanisms. By providing a new adjustable wobble plate with solid metal column support, pin-ended bearings and cantilevered tilt platforms are no longer needed. Pump rigidity is maximized while pump envelope size and noise are minimized. Additional possibilities are then available to dynamically control pump timing, promising further improvements in pump performance and noise control.

These and other advantages of the invention will be apparent from the following detailed description with reference to the appended drawings.

DETAILED DESCRIPTION

Figure 1A:
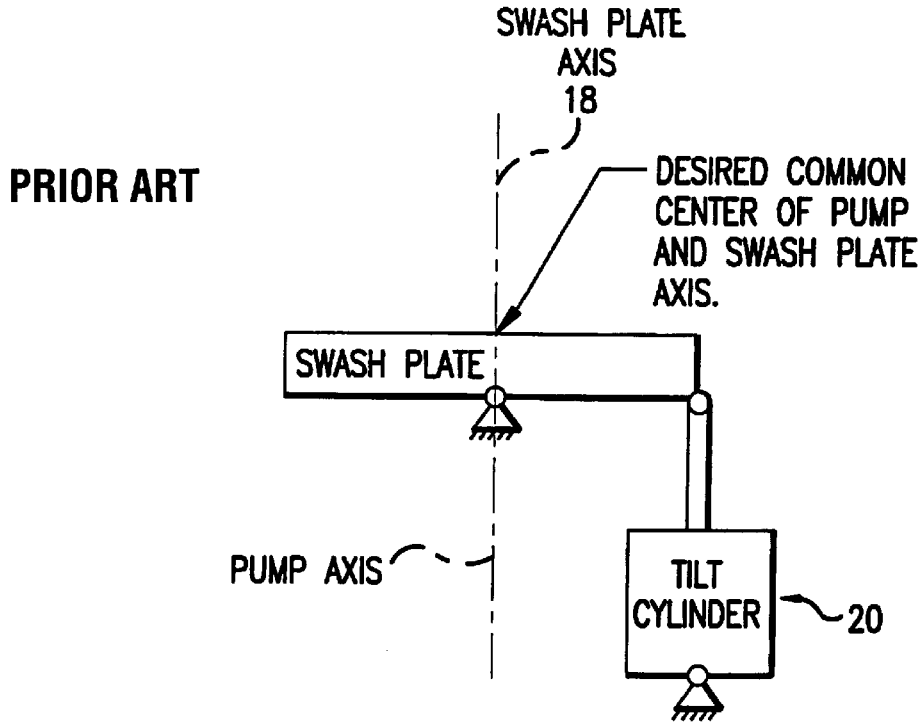
FIGS. 1A and 1B are schematic diagrams of a conventional swash plate assembly in two positions.

Generally a control system, method and apparatus are provided in which a rotatable wedge portion 10 which is solidly mounted on a rotatable base 12. The base 12 is fixed to a rotatable shaft 22. The wedge portion 10 engages piston and cylinder assemblies as the shaft 22 and base 12 rotate. The wedge 10 is rotatable through various positions relative to the base 12, thus providing an adjustable tilt angle and varying strokes for the pistons. In another embodiment which is illustrated in FIGS. 8A through 8F, the single wedge is replaced by an adjustable double wedge assembly 30, 32.

In yet another embodiment, the base 12 and wedge 10 are not fixed to the shaft 22, but allowed to rotate with respect thereto. Rather the outer case, pistons and cylinder assemblies are rigidly fixed to the shaft 22, and will rotate with the shaft 22. The base 12 thus does not rotate with the shaft 22 but the pistons rotate with respect to the base 12.

In the description, first an analysis of typical axial pump timing error and the effects of such error on performance and noise will be presented. Particular attention will be paid to the effects on noise due to trapped oil volume caused by timing overlap at the inlet to outlet valve transition. Graphs of trapped volume/cycle versus pump stroke for this pump configuration profile will be shown. These graphs will be discussed along with their impact on pump design and noise reduction.

Theory and application for the new adjustable stroke control module will be presented. Renderings of three dimensional solid modeling will also be included to illustrate the new application. Exemplary modifications to a typical axial hydraulic pump using the new module will be shown for comparative purposes.

The following nomenclature is used in this description:

D=Cylinder barrel pitch diameter
$d_p$=Piston diameter
$d_\alpha$=Minimum port transition angle
$\alpha$=Inlet to outlet port transition angle
$\alpha_t=\alpha-d_\alpha$, Trapped volume angle
$\theta$=Cylinder barrel rotation angle
$\beta$=Platform tilt angle
$\beta_0$=Wedge angle
$\phi$=Wedge stroke adjustment rotation angle
$\phi_0$=Wedge pre-rotation set angle
$P_0$=Pump output port pressure
$P_i$=Pump input port pressure
N=Number of cylinders
$\mu$=Coefficient of friction Typical axial hydraulic pumps make use of a pin-ended tilting platform to support the full pumping thrust loads and provide a method for tilting the swash plate. Tilt of the swash plate in turn provides the necessary pump stroke and adjustable displacement. Developing a pin-ended yoke, that is, a pivoting bridge structure, of sufficient structural strength and rigidity leads to added weight and cost. Design compromises often lead to increased noise as well.

If the mechanism is not sufficiently rigid, pumping load distortions of the cantilevered swash plate can be significant and of the same order as the stroke for small displacement. This leads to control instability. If the mechanism is sufficiently rigid it is also likely to be heavy and reduce response time as well as increase weight and cost.

Figure 1B:
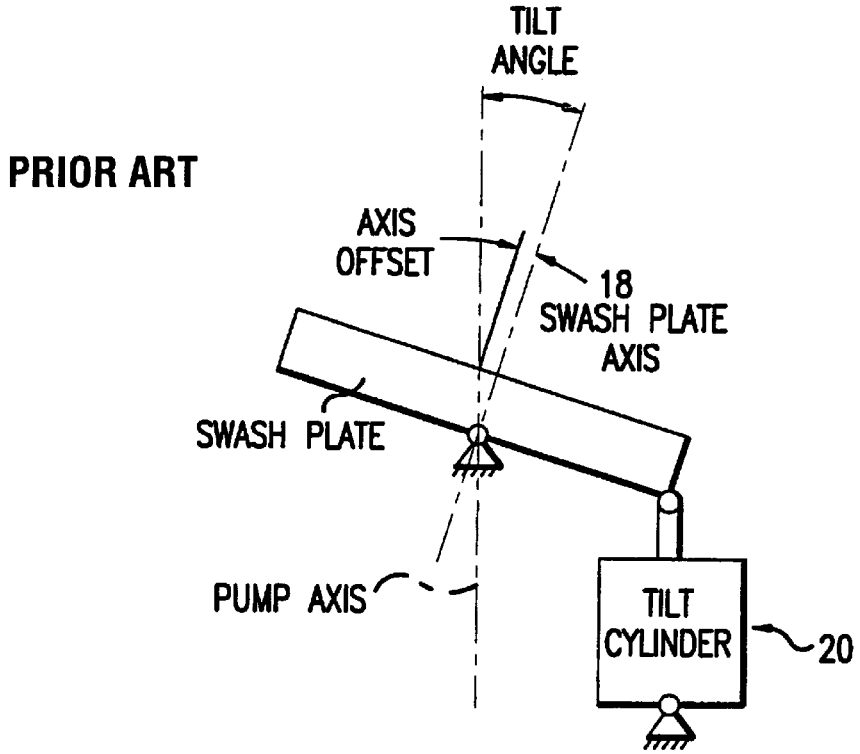

A further difficulty with present axial configurations as shown in FIG. 1 is that the tilt mechanism pivot axis 18 used for the swash plate does not pass through the center of the plane of the swash plate. The yoke is then controlled by a hydraulic tilt cylinder 20 or other thruster at one edge. This provides for the most convenient configuration under the circumstances but results in increasing offset of the swash plate center line as the swash plate is tilted. Special bearing and support mechanisms must then be added to compensate for this and to force the centered alignment of the piston rods. In some cases centering is maintained by a ball and socket arrangement with a ball attached to the rotating drive shaft and a mating socket on the swash plate. This approach, which is common, introduces undesirable axial loading as well as structural bending moments to the shaft.

Further, as can be seen from FIG. 1, the offset swash plate pivot swings the swash plate from side to side requiring additional side clearance within the case for the swinging yoke basket which adds further to weight and cost.

By replacing the suspended pin-ended yoke assembly with a wedge mechanism, a more robust, compact and rigid tilt platform is presented to the spinning swash plate. One embodiment of this approach is shown in FIG. 2.

Figure 2A:
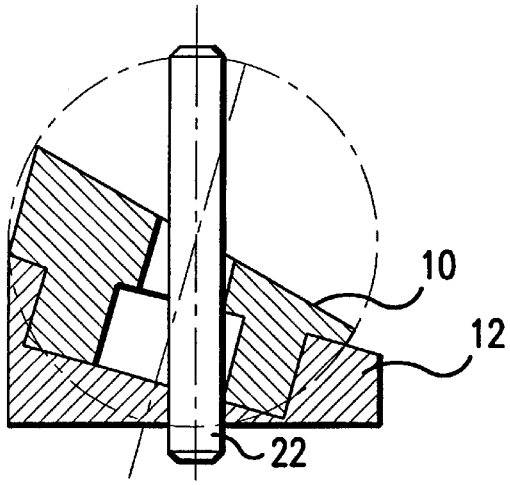
FIGS. 2A, 2B and 2C are schematic diagrams of a control mechanism according to the invention, showing three positions of a wedge portion.
Figure 2B:
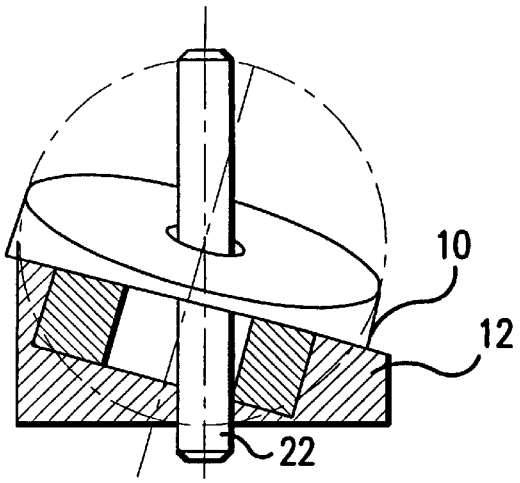
Figure 2C:
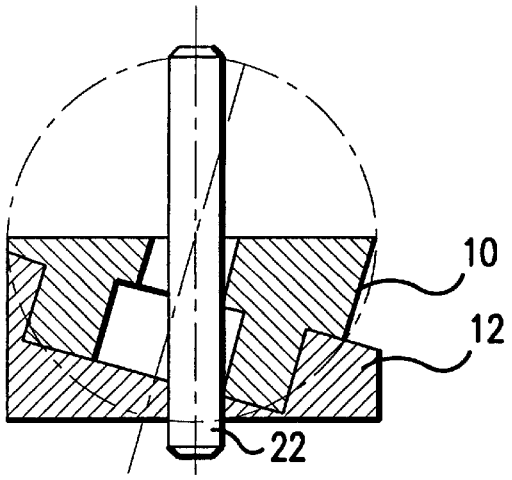

As seen in FIGS. 2A through 2C a single wedge 10 mounted on a base 12 rotates about an axis tilted relative to the rotating shaft 22, thus spinning the cylinder barrel/piston/swash plate assembly 24 of the pump. In one embodiment, the base 12 and wedge 10 rotate with respect to the cylinders and pistons. In the other embodiment, the shaft 22 is rigidly connected to the cylinder and piston assembly while the base 12 and wedge 10 are held stationary. In both embodiments, when the wedge is rotated relative to the base, the plane of the swash plate is changed or tilts, thus changing the pump stroke. This provides several advantages over conventional approaches.

Compact

- Diameter need not exceed the swash plate diameter
- No change in clearance with tilt
- No external actuators required to achieve tilt Robust

- Rigid solid column axial support
- Potential for reduced noise
- Center of the swash plate remains fixed at all tilt angles
- Large tilt angles (stroke) are easily achieved
- Axial loads are normal to the plane of wedge rotation
- Control forces need only rotate the wedge Lower Cost

- No pin-ended yoke bearings
- No high point-load bearing problems
- No assembly alignment problems
- No external actuators required
- Smaller, simpler, more rigid case configuration Timing Effects As shown in FIG. 1, the tilt axis for a conventional axial piston pump would be perpendicular to the plane of the paper. This is as expected and is so shown for the new mechanism of FIG. 2A at maximum tilt/stroke. However, at all intermediate positions the tilt axis of the new mechanism is no longer normal to the plane of the paper and is in fact rotating as the wedge 10 is rotated. This axis lies in the horizontal plane and its position, known as the strike' of the plane, is one-half the angle of rotation of the wedge or $\phi/2$. Rotating the wedge from an aligned maximum tilt position to zero tilt requires 180° rotation of the wedge as shown in FIG. 2C, which means the tilt axis is rotated to 90°. While the tilt axis is not normal to the plane of the paper in this case, the tilt plane is correctly seen on edge because the tilt and stroke are identically zero.

Thus, while wedge rotation produces a corresponding rotation in the tilt axis and timing, it all occurs at correspondingly reduced stroke. The actual effects upon pump performance and noise signature are analyzed below.

Trapped Volume Per Cycle as a Function of Pump Stroke

Figure 3:
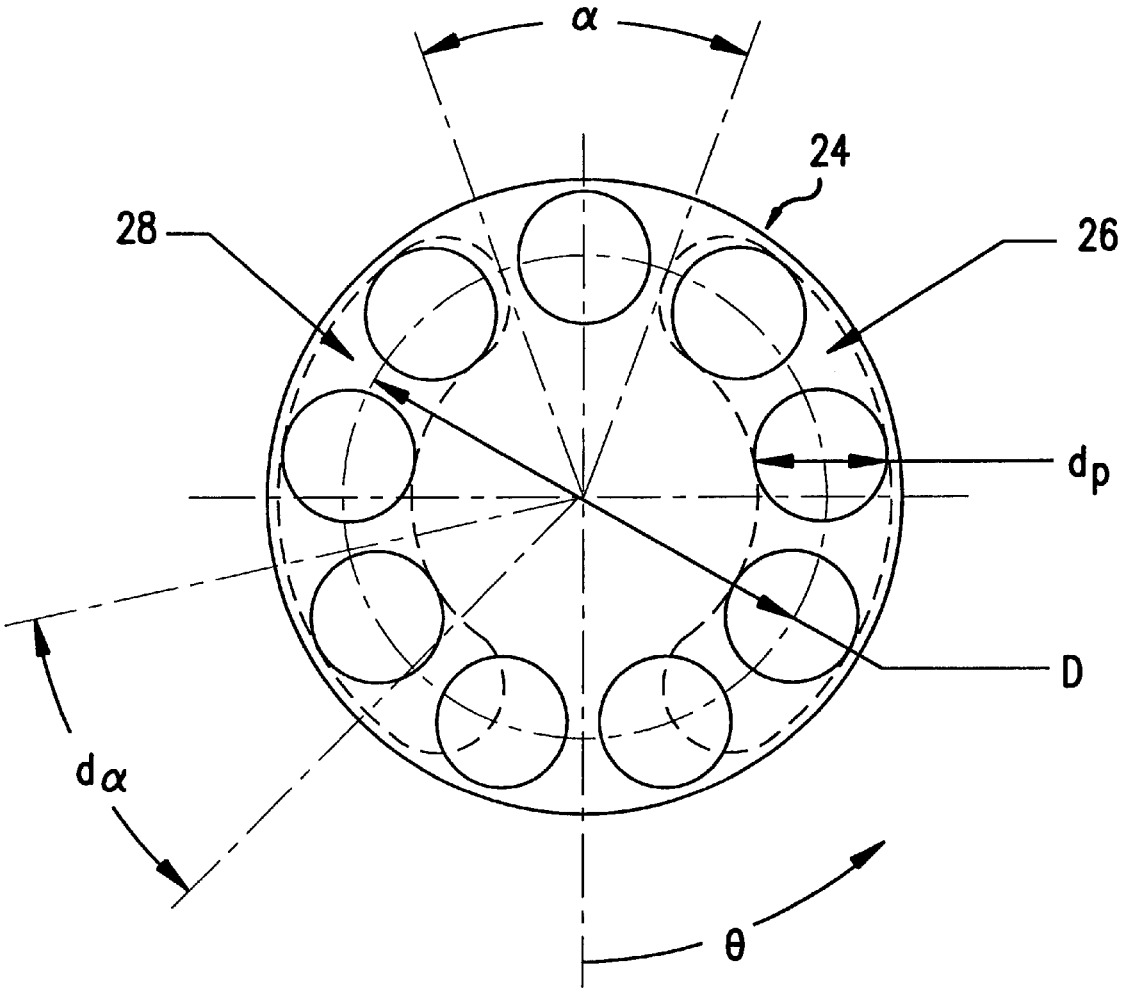
FIG. 3 is a schematic diagram of a porting arrangement of an axial pump.

It is possible to calculate the amount of volume trapped within a rotating cylinder as the cylinder and its port crosses from the inlet port area 26 to the outlet port area 28. The configuration is schematically shown in FIG. 3.

The inlet and outlet ports are symmetrically positioned about the axis perpendicular to the tilt axis. As a given cylinder rotates and moves toward the transition angle, $\alpha$, between the ports the piston takes in fluid and reaches bottom dead center (BDC) as it moves through the transition zone. Within the transition zone a the cylinder is sealed off, emerging over the outlet port area as the piston begins to deliver fluid to the high pressure side. This continues until the piston reaches top dead center (TDC) where transition occurs over the inlet port once again. For purposes of simplification the schematic is drawn symmetrically, although in many cases there may be practical reasons for some asymmetry.

Since the piston stroke is a sinusoidal function of the cylinder position of rotation, it is at a maximum and minimum at TDC and BDC, respectively. Only at these precise points is the piston reversing direction and passing through the zero point. Also, since the transition angle is finite, not zero, the piston is moving within the transition zone, sealed off and hydraulically locked. Note that this is a serious source of noise, destructive vibration and occurs even under conditions of what might be termed "perfect timing".

Pump designers are well aware of this problem but the realities of conflicting performance objectives force the compromise. To prevent cross flow leakage from the outlet port to the inlet port $\alpha$should be as large as possible. On the other hand, to reduce the hydraulic lock problem the transition angle should be reduced to $d_\alpha$. In practice these angles are altered to some intermediate compromise angle with relief grooves or orifices employed to cut down on the effects of hydraulic lock and its associated noise.

Trapped Volume Calculations

Figure 4A:
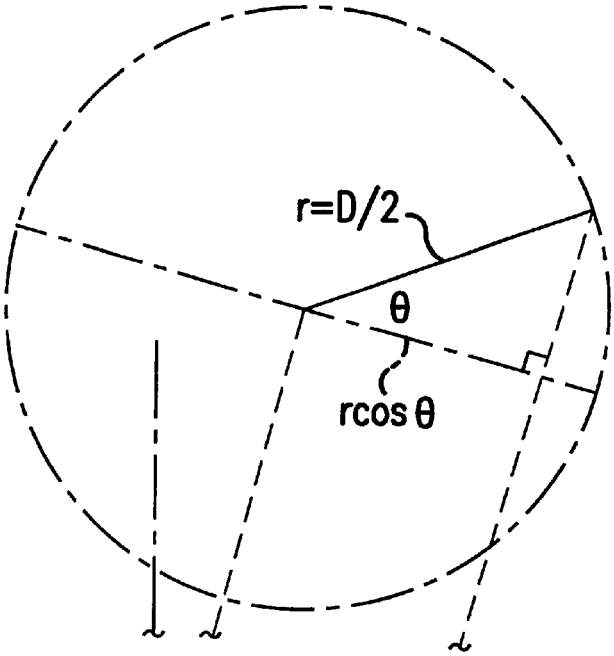
FIGS. 4A and 4B are schematic diagrams of the edge view geometry of the new control mechanism.
Figure 4B:
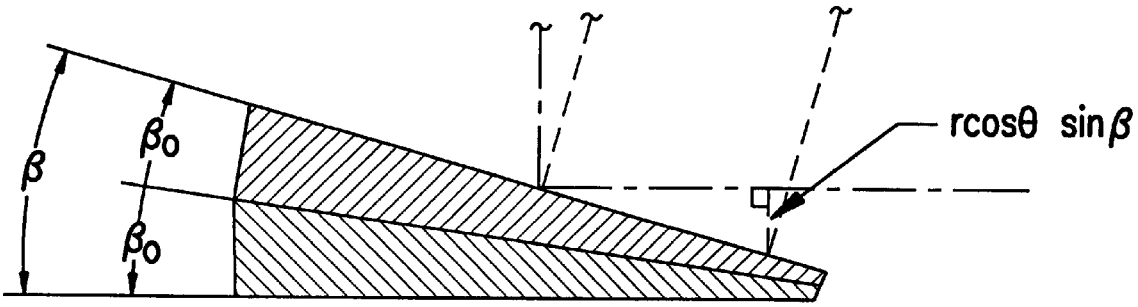

FIG. 4B shows an edge view schematic of the geometry of a tilted platform. Platform tilt angle $\beta$ is assumed to remain constant as the cylinder barrel rotates through angle $\theta$. For the wedge system, both wedge sections are assumed of equal angle $\beta_0$, for reasons which will later become clear. Displacement may now be calculated as, $$Displacement = \left(\frac{\pi d_P^2 N}{4}\right) 2\int_{\theta=0}^{\theta=90^\circ} r\cos\theta\sin\beta d\theta.$$

Performing the integration then produces the expected total displacement of, $$Displacement = \left(\frac{\pi d_P^2 ND}{4}\right)\sin\beta.$$

The trapped displacement volume during transition for the two transitioning cylinders at TDC and BDC then becomes, $$Displacement_t = \left(\frac{\pi d_P^2 2D}{4}\right)\sin\beta(\sin\theta_2 - \sin\theta_1).$$

where $\theta_1$ and $\theta_2$ are the start and stop angles for the transition section $\alpha$.

Note that the trapped displacement is zero only if $\theta_1=\theta_2$. For all real cases, the transition angle is not zero. Since $\alpha$ is the manufactured transition angle, the trapped volume overlap angle $\alpha_t$ becomes, $$\alpha_t = \frac{2\pi}{N} - d_\alpha, \text{ where } d_\alpha = 4\arcsin\left(\frac{d_P}{2D}\right)$$

and equation (3) may be rewritten in the more convenient form, $$Dispacement_t = \left(\frac{\pi d^2 2D}{4}\right)\sin\beta\sin\alpha_t.$$

Again, this term will not be zero unless at $\alpha_t=0$.

Using typical values from axial pump manufacturers, the trapped displacement can be calculated. For a popular 11 cylinder pump, $\alpha_t=8.4°$ and the trapped displacement volume is 2.66% of the pump's maximum displacement. This is not an unusually high figure. By using transition leakage grooves the effects can be reduced, but with some loss in efficiency. The situation can be improved by increasing the number of pistons, N, which reduces $\alpha$.

Timing Effects on Trapped Volume

If the tilt axis becomes 'misaligned' by some angle $\theta_\Delta$, then the trapped volume percentage becomes, $$\%Displacement_t = (\sin(\theta_\Delta + \alpha_t) - \sin(\theta_\Delta))\frac{2}{N}.$$

Surprisingly, this value is a maximum at $\theta_\Delta=0$. This so-called 'mistiming' reduces the effective trapped volume. This is because tilt axis misalignment occurs at other than TDC/BDC and, therefore, at a point of reduced stroke which reduces the trapped volume.

However, there are other important factors to be considered. There may be unfavorable inertial effects from the more rapidly moving liquid column at the time of transition. Volumetric efficiency is being lost since TDC/BDC transition is occurring within the port area. This loss in volumetric efficiency may actually be exploited to provide variable output flow without changing the fixed tilt angle. Viscous losses can be expected to increase however.

From the above it is clear that even "perfect" port timing is not as perfect as might be believed. There will always be some trapped volume to contend with as a source of noise and hydraulic lock loading. Good design can minimize these problems but not eliminate them. As previously shown, mistiming due to off axis rotation of the tilt axis is not a problem.

Since the new single wedge system inherently produces rotation in the tilt axis, it is important to determine the effects of tilt axis rotation on that system. Referring to FIG. 4, $$\beta = 2\beta_0\cos\left(\frac{\phi + \phi_0}{2}\right), \text{ where } \phi + \phi_0 = 0 \rightarrow 180°,$$

so for an initial preset rotation of $\theta_0=90°$, then the angle $\phi=0\rightarrow 90°$, and the rotation from maximum tilt to zero tilt is cut in half with no change in the total maximum tilt, although the initial angle machined on the wedge, $\beta_0$, will be increased to produce the desired final angle $\beta$.

Figure 5:
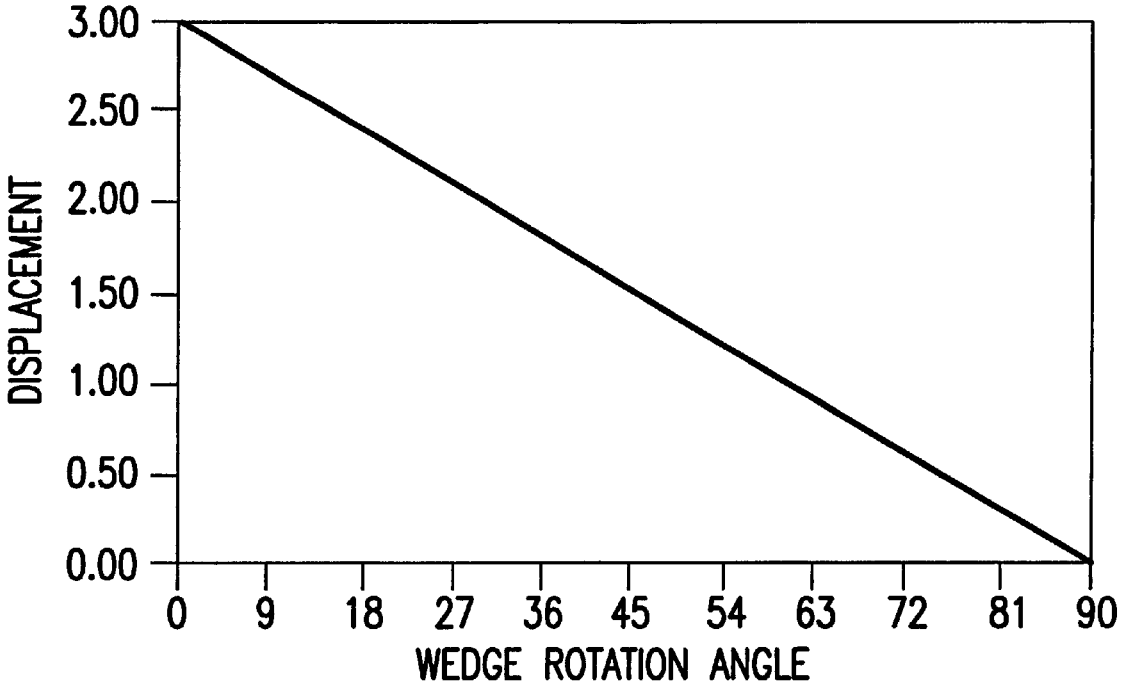
FIG. 5 is a graph plotting wedge rotation versus pump displacement.

The relationship between $\beta$ and the wedge rotation is purely sinusoidal. As a result, there is little change in $\beta$ or stroke during the first 90° of wedge rotation. By pre-rotating the wedge this first 90° and then back-rotating the fixed base wedge until the tilt axis is returned to alignment, tilt versus wedge rotation occurs only over the more linear portion of the curve as shown in FIG. 5. An added benefit is that the out of alignment rotation of the tilt axis during wedge rotation is also greatly reduced.

Out of alignment rotation of the tilt axis results in TDC and BDC occurring within the port area. While this does not exacerbate the trapped volume problem, it does cause fluid to be pulled into the cylinder and partially expelled back into the same port before the transition area is reached and the cylinder is sealed off. This internal "breathing" of the pump produces a reduction in flow output from the pump without a need for change in stroke. There are pumps currently marketed which intentionally create such internal re-cycling as a simplified means to achieve variable output.

A serious disadvantage to that approach is the viscosity loss produced as fluid is re-cycled through the cylinders. For zero output the entire fixed displacement of the pump would be re-cycled internally.

For the present single wedge system the rotation of the tilt axis is coupled with a reduction in stroke. The breathing percentage produced within the pump can be shown to be, $$Displacement_B^{\%} = \frac{(Displacement_{\theta\Delta=0} - Displacement_{\theta\Delta})}{Displacement_{\max}}$$

which may be rewritten as:

$$Displacement_B^{\%} = \left(\sin\left(2\beta_0\cos\left(\frac{\phi + \phi_0}{2}\right)\right)\left(1 - \cos\left(\frac{\frac{\phi}{2}}{1 - \frac{\phi_0}{\pi}}\right)\right)\right)\frac{200}{N\sin\beta}$$

Figure 6:
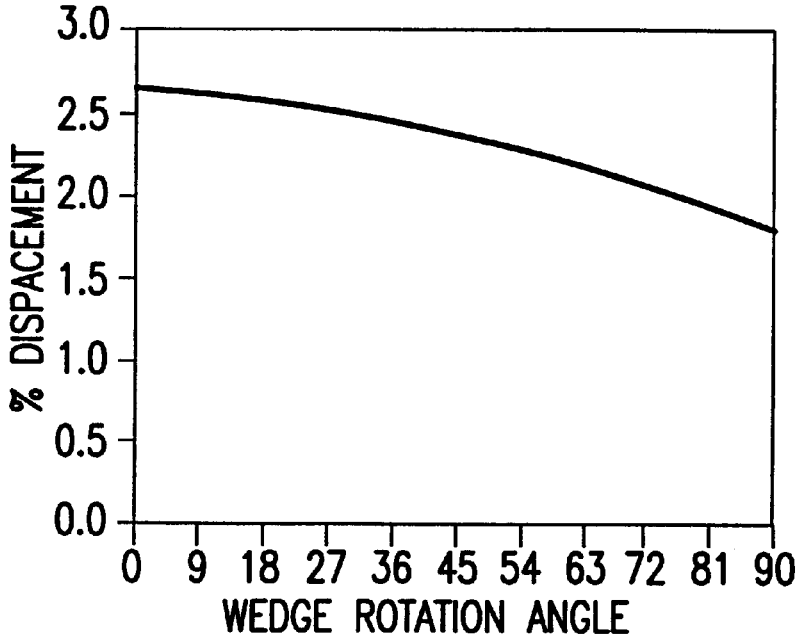
FIG. 6 is a graph plotting trapped displacement volume versus wedge rotation.

Trapped displacement error is plotted in FIG. 6 for a typical axial piston pump as retrofitted with the present system.

As expected, the trapped displacement percentage is reduced with wedge rotation.

Figure 7:
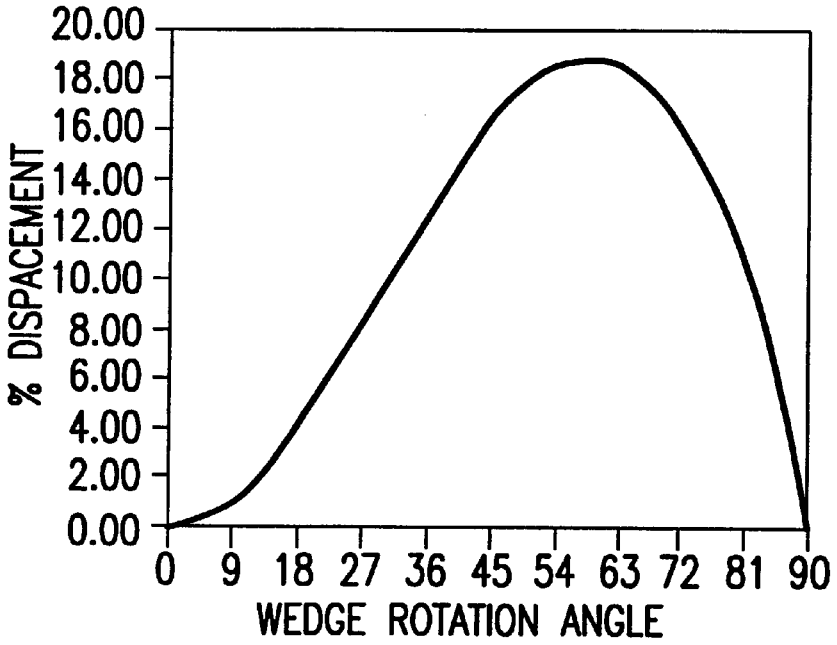
FIG. 7 is a graph plotting breathing volume versus wedge rotation.
Figure 8A:
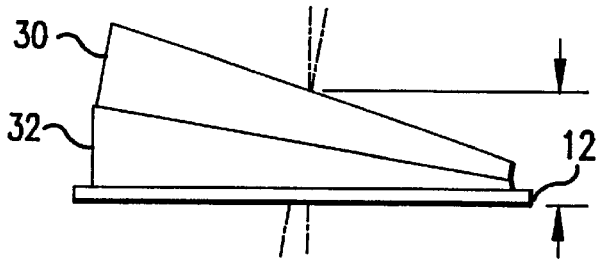
FIGS. 8A through 8F are a series of side views of another embodiment of the invention including two wedge portions in various positions.
Figure 8B:
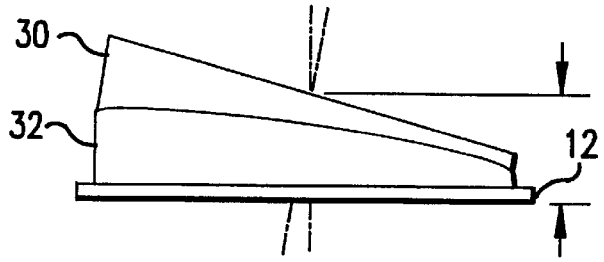
Figure 8C:
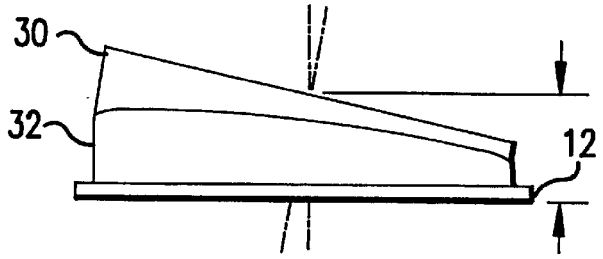
Figure 8D:
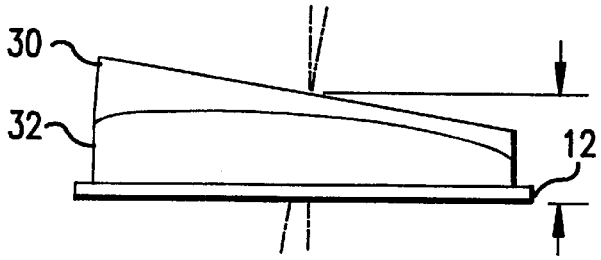
Figure 8E:
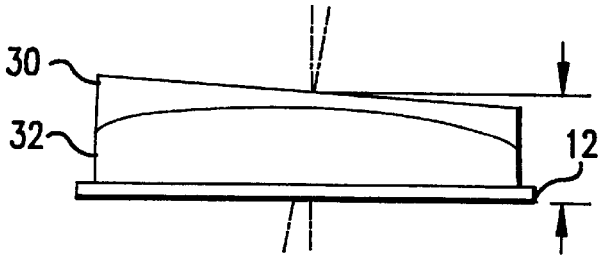
Figure 8F:
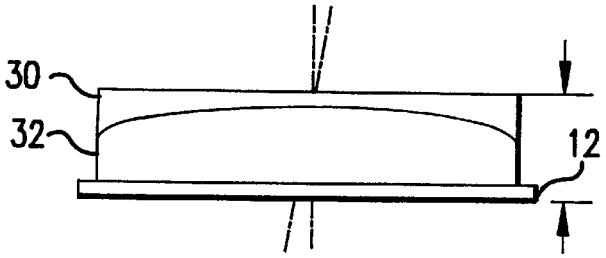
Figure 9A:
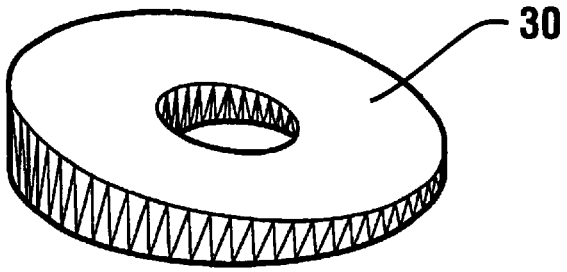
FIGS. 9A through 9C show in three dimensions the main component parts of a double wedge embodiment which is driven hydraulically using internal vanes.
Figure 9B:
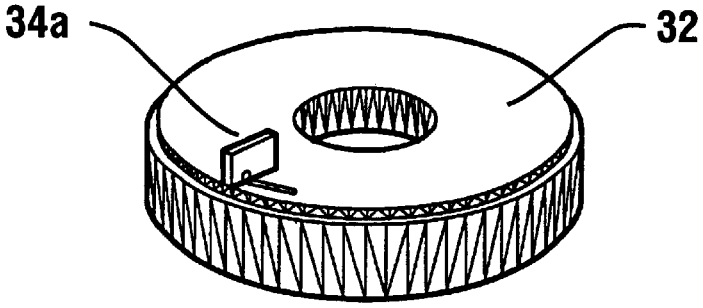
Figure 9C:
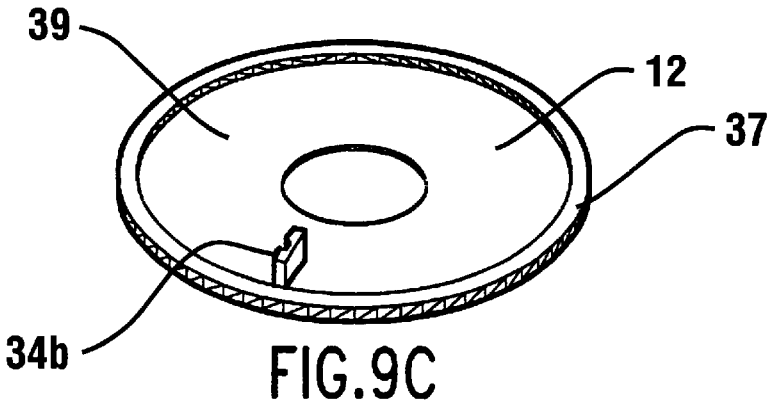
Figure 9D:
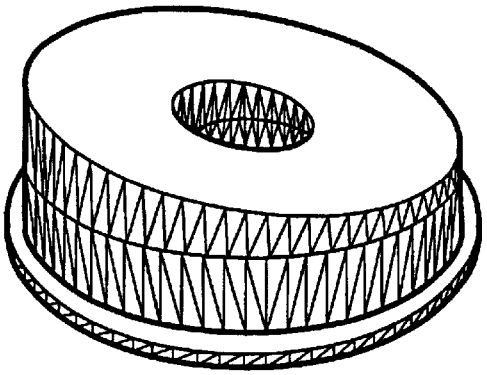
FIG. 9D shows in three dimensions the assembled view of the three components illustrated in FIGS. 9A through 9C.

FIG. 7 shows pump breathing data for the present system. As rotation of the tilt axis increases the amount of pump breathing, that same wedge rotation reduces the pump stroke. As a result, midway through the wedge rotation, stoke reduction becomes the predominant influence and the amount of pump breathing returns to zero. For the selected and typical axial piston pump, as retrofitted with the new system, the amount of pump breathing peaks at 18.2%.

Double Wedge System

A double wedge system is shown in FIGS. 8A through 8F. One wedge or top wedge 30 may be pre-rotated for advantage and the base wedge 32 back-rotated to re-align the tilt axis. This relationship is geometrically coupled and by using a double wedge system where a base wedge rotates $\phi$ and the upper wedge rotates $-\phi$, the tilt axis rotation induced by one wedge's rotation being exactly removed by the other wedge's counter rotation. The wedge 30 is affixed to the base wedge 32 which in turn is mounted to the base 12. In the first embodiment, the base 12 is attached to the shaft 22 and rotates with the shaft 22 as it turns. In the second embodiment, the base 12, and wedges 30,32 are not mounted to the shaft 22, but allowed to rotate with respect to the shaft 22 as the shaft 22 rotates with the affixed case, cylinders and pistons.

Renderings of three dimension modeled parts are shown in FIGS. 8A through 8F for a system designed for a 45° pre-rotation set. Note that for the double wedge case the maximum rotation is 90° respectively for each counter rotating wedge, for a total included angle of 180°. Observe that the tilt plane is always an edge view and that the swash plate center point remains fixed throughout the range of adjustment. FIGS. 9A through 9D show three dimension renderings of a double wedge stack, hydraulically driven via internal vanes 34*a* and 34*b*. Since the top wedge 30 is carried by the base wedge 32, the top wedge must rotate $-2\phi$ relative to the base lower wedge while the base lower wedge rotates $-\phi$ to maintain the same $-\phi/+\phi$ relationship to fixed coordinates.

Oil ports are shown which deliver control pressure to the vane actuator mechanisms. The system is self contained within the wedge assembly itself with the exception of external return springs, not shown for clarity. For a single wedge system the stack would not include a rotating base with its bearing and port system. Rather, the base wedge 32 would then become the fixed base unit with the top wedge 30 the only moving part.

For most applications, this simpler approach should prove adequate; since, as already shown, the added complexity to guarantee no rotation of the tilt axis provides no substantive performance advantage.

When implementing the double wedge assembly, care must be taken to account for the frictional torque moment imparted by the spinning pump swash plate. This torque component affects only the upper wedge so that maintaining the $-2\phi$ and $+\phi$ angular relationship between the upper and lower wedges becomes problematic. This can be corrected by placing a thin pin-ended torque plate 35 between the top wedge and the swash plate. This should not be confused with the heavy pin-ended yoke found in typical axial pumps. In this case, the torque plate passes all axial loading through to the wedge stack in direct compression. The pin-ends 36 rest in retaining supports which need only fit loosely and carry shear loads equal to those produced by the induced frictional moment.

In the single wedge example, the torque plate 35 may not be necessary. Indeed, the frictional moment may be used to assist or substitute for the return spring, further simplifying the concept.

The wedge assembly is very adaptable to axial pump design. It can provide the basis for a totally new pump design, or be easily adapted to retrofit many existing axial pumps.

Figure 10:
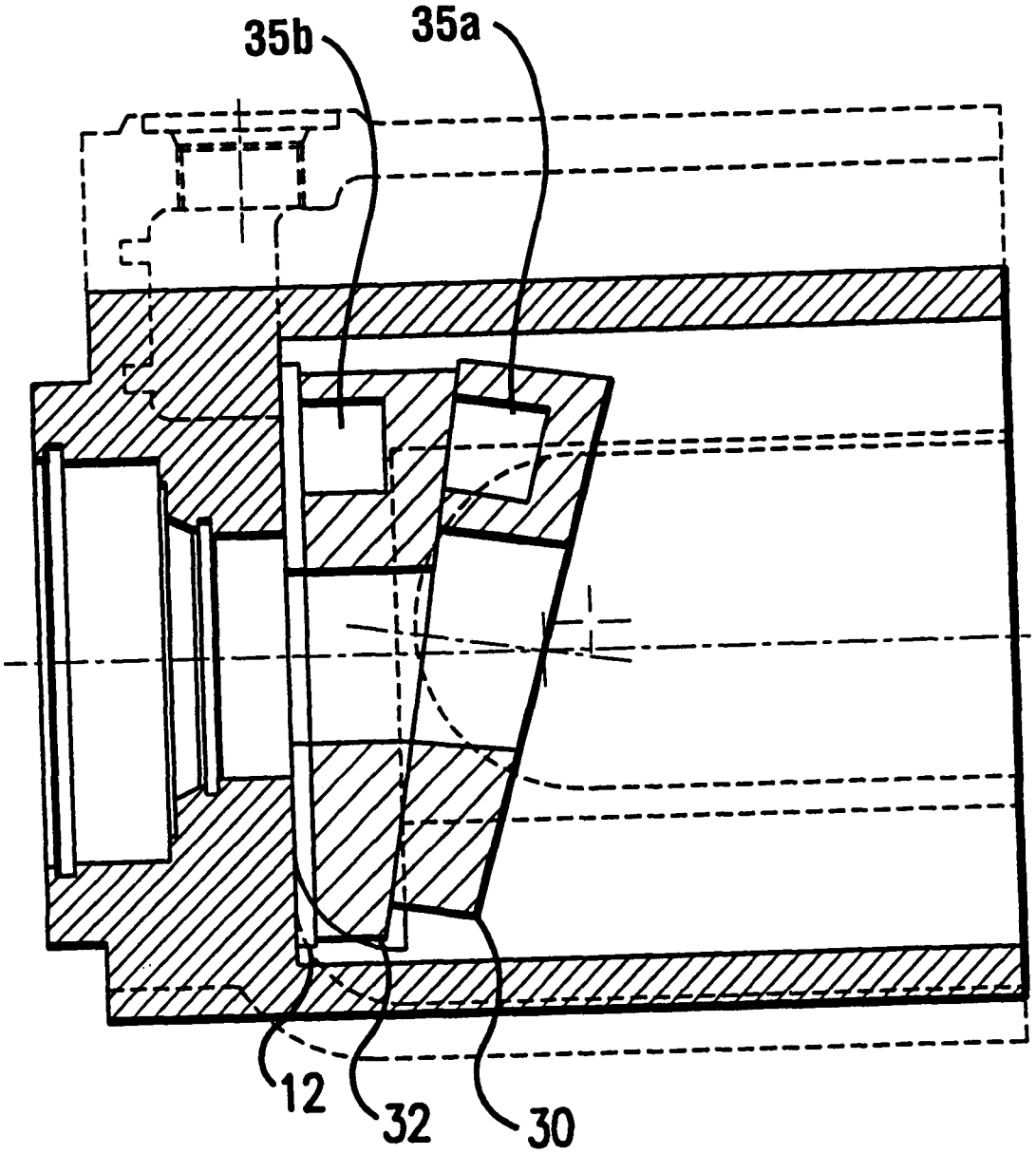
FIG. 10 is a cross section of a conventional axial pump retrofitted using the present invention.

The invention may be used for retrofitting existing axial pumps. FIG. 10 shows a sectional view of a typical retrofit installation using the double wedge assembly. An overlay, shown in hidden line, of the present pump case demonstrates that significant reduction in size is possible. To retain the use of all other pump components without modifications, the wedge stack must be thick enough to present the tilt plane at the same center location as the original pump yoke assembly. A pump retrofit design using the compact wedge assembly may have a shorter case as well as a smaller diameter case while still retaining the original pump assembly of ports, cylinders, pistons and swash plate.

Figure 11:
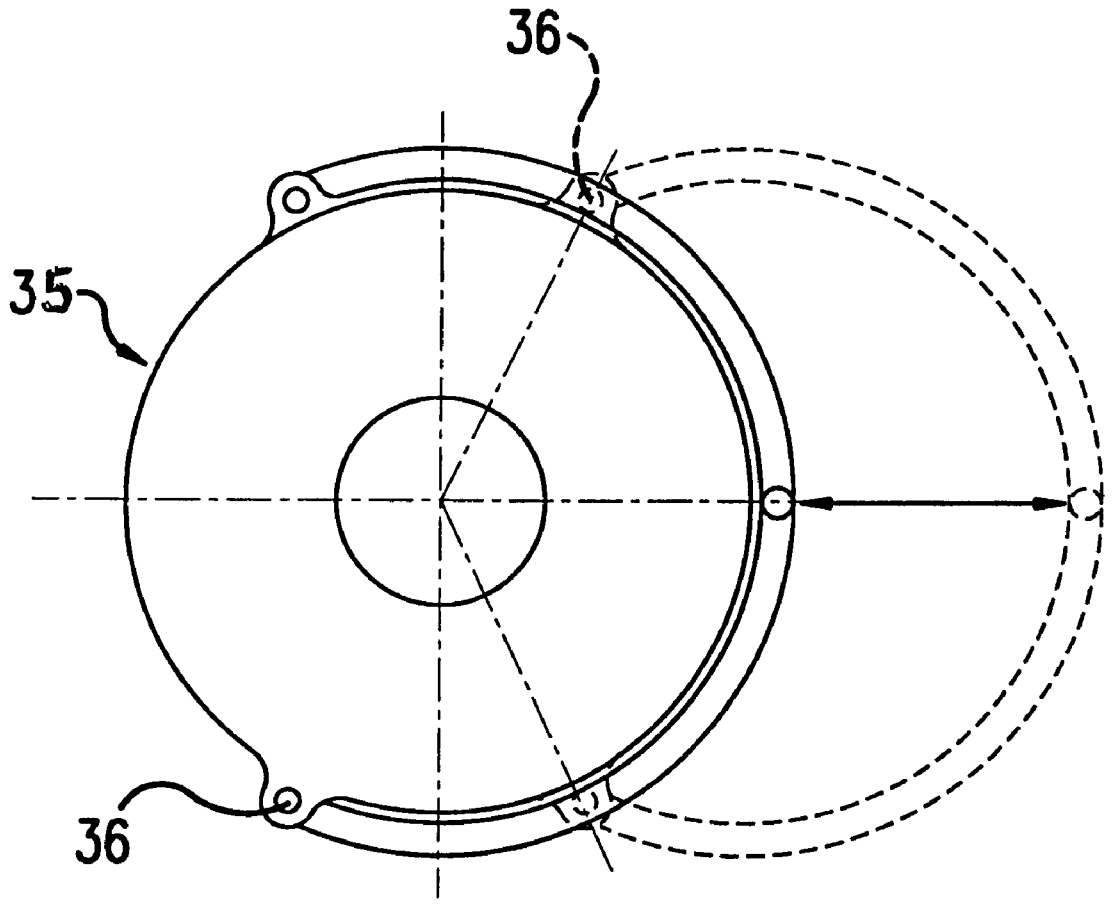
FIG. 11 shows mechanical means for such a retrofit.
Figure 12:
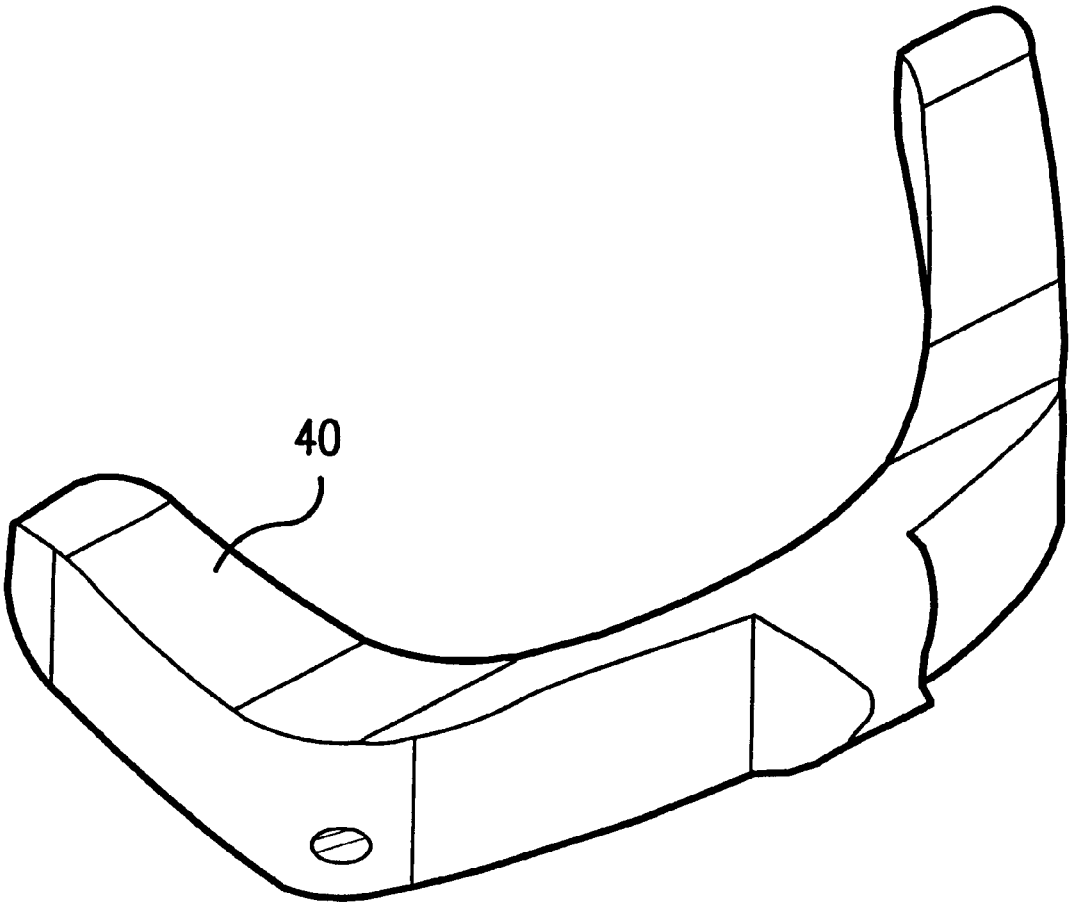
FIG. 12 is a three dimensional rendering of a control link for such a retrofit.

In some instances it may be desirable for production reasons to retrofit a pump while retaining the existing control mechanism. This would allow for the use of the rigid and compact wedge assembly but without changing the control porting and actuators. While not as compact or technically forward, it presents a less challenging and faster track to production. FIG. 11 shows schematically one means for accomplishing this retrofit mechanically. FIG. 12 shows a three dimension rendering of a retrofit control link as applied to a current axial pump.

Generally, the system provides a compact, rigid and robust replacement for typical pin-ended yoke tilt assemblies for adjustable axial pumps. This improved rigidity and stiffness should reduce vibration and noise. The inherent simplicity should also lead to lower cost of production while improving durability.

In design of an actual system, specific analysis of specific frictional moments, static and dynamic loading and hydraulic control parameters will be required.

Various changes and modifications may be made in the above described system, method and apparatus which will fall within the scope of the following claims.

What is claimed is:

1. Apparatus for controlling an axial pump having a drive shaft with an axis of rotation and a plurality of pistons parallel to and surrounding an extension of said shaft of rotation beyond said drive shaft, comprising:

a. a base member 12 surrounding said drive shaft and rotatable with respect thereto, said base member including a circular recess with a flat surface surrounding said shaft and facing said pistons, and b. a first wedge member having an annular portion which is rotatably received within said circular recess and solidly mounted on said base member between said base member and said pistons, said first wedge member having first and second opposed non-parallel flat faces, said first of said opposed faces of said first wedge member engaging said flat surface of said base member and said second of said opposed faces of said first wedge member being in driving relationship to said pistons, c. whereby rotation of said first wedge member relative to said base member adjusts the angle formed by said axis and said second of said opposed faces of said first wedge member to control movement of said pistons.

2. Apparatus according to claim 1 wherein rotation of said first wedge member is hydraulically controlled.

3. Apparatus according to claim 1 and further comprising a second wedge member rotatably mounted on said first wedge member between said first wedge member and said pistons, said second wedge member having first and second opposed non-parallel flat faces, said first of said opposed faces of said second wedge member engaging said second face of said first wedge member and said second of said opposed faces of said second wedge member being in driving relationship to said pistons, whereby rotation of said second wedge relative to said first wedge member adjusts the angle formed by said axis and said second of said opposed faces of said second wedge member to control movement of said pistons.

4. Apparatus according to claim 3 wherein said first wedge member includes a recess surrounding said drive shaft and said second wedge member includes an annular portion extending from said first opposed face of said second wedge member into said recess of said first wedge member in mating relationship therewith whereby said second wedge member is solidly mounted on said base member.

5. Apparatus according to claim 3 wherein rotation of said second wedge member is hydraulically controlled.

6. A method of controlling an axial pump having a drive shaft with an axis of rotation and a plurality of pistons parallel to and surrounding an extension of said axis of rotation beyond said drive shaft, comprising:

a. providing a base member surrounding said shaft and rotatable with respect thereto, and providing said base member with a circular recess having a flat surface facing said pistons, b. providing a wedge member having an annular portion which is rotatably received within said circular recess and solidly mounted on said base member between said base member and said pistons, c. connecting said shaft to said pistons to rotate said pistons and shaft with respect to said base member and wedge, and d. rotating said wedge member to change the angle one surface of said wedge member forms with said axis to control movement of said pistons.

7. The method of claim 6 and the further step of providing a second wedge member rotatably mounted on said first wedge member between said first wedge member and said pistons, said second wedge member having first and second opposed non-parallel flat faces, said first of said opposed faces of said second wedge member engaging said second face of said first wedge member and said second of said opposed faces of said second wedge member being in driving relationship to said pistons, whereby rotation of said second wedge relative to said first wedge member adjusts the angle formed by said axis and said second of said opposed faces of said second wedge member to control movement of said pistons.

8. Apparatus for controlling an axial pump having a drive shaft with an axis of rotation and a plurality of pistons parallel to and surrounding an extension of such shaft of rotation beyond said drive shaft, comprising:

a. a base member surrounding said drive shaft and rotatable with respect thereto, said base member including a circular recess surrounding said drive shaft and facing said pistons, b. a first wedge member having an annular portion which is rotatably received within said circular recess and mounted on said base member between said base member and said pistons, said first wedge member having first and second opposed non-parallel flat faces, said first of said opposed faces of said wedge member engaging said flat surface of said base member, c. a second wedge member rotatably mounted on said first wedge member between said first wedge member and said pistons, said second wedge member having first and second opposed non-parallel flat faces, said first of said opposed faces of said second wedge member engaging said second face of said first wedge member and said second wedge member being in driving relationship to said pistons, whereby rotation of said second wedge member relative to said first wedge member adjusts the angle formed by said axis and said second of said opposed faces of said second wedge member to control movement of said pistons.

9. The apparatus of claim 8 and further comprising an upstanding perimeter wall extending around said circular recess, said circular recess surrounding said drive shaft and facing said pistons, and said annular portion of said first wedge member received within said upstanding wall extending around said recess.

* * * * *